United States Patent [19]

MacRae

[11] 4,216,966

[45] Aug. 12, 1980

[54] BOARD GAME SIMULATING DRUNK DRIVING

[76] Inventor: Thomas H. MacRae, 4948 Bryant Ave. S., Minneapolis, Minn. 55409

[21] Appl. No.: 926,096

[22] Filed: Jul. 19, 1978

[51] Int. Cl.[2] ..... A63F 3/00

[52] U.S. Cl. ..... 273/243; 273/289

[58] Field of Search ..... 273/251, 252, 254

[56] References Cited

U.S. PATENT DOCUMENTS

| | | | |
|---|---|---|---|
| 1,085,371 | 1/1914 | Watterson | 273/251 |
| 4,081,183 | 3/1978 | Urban | 273/249 |

FOREIGN PATENT DOCUMENTS

| | | | |
|---|---|---|---|
| 709543 | 5/1954 | United Kingdom | 273/252 |
| 1386097 | 3/1975 | United Kingdom | 273/252 |

OTHER PUBLICATIONS

*Safety Belt Game;* last page; *Selected U.S. Govt. Publications;* 3/1974; vol. 3, No. 3.

*Primary Examiner*—Richard C. Pinkham
*Assistant Examiner*—R. Carl Moy
*Attorney, Agent, or Firm*—Wicks & Nemer

[57] ABSTRACT

A game board apparatus based on possible experiences of a player consuming liquor in relation to a time span in liquor establishments which includes a game board having a series of playing locations thereon and forming a playing path about the board. The liquor establishments are adjacent some of the playing locations. Player tokens are provided for moving on the playing locations and the stop locations. A pair of dice is used to move the player tokens about said playing and stop locations. A series of cards each bearing indicia indicating a type of drink, its liquor content, a message to the player, the amount of liquor consumed and the time spent during the consumption is provided. A blood alcohol concentration level chart is provided which has time increments versus ounces of liquor for ascertaining a state of drunkenness. A display board is provided which includes a dial for recording elapsed time and a dial to record the amount of liquor consumed. The player token is provided with a removable rigid head to indicate sobriety which is replaced by a head which flexes to indicate drunkenness. A series of cards is provided on each of which is indicia stating possible consequences to a player who is drunk and lands on a road hazard playing location. A police car is also provided as a means of eliminating a drunken driver from the game. The police car is moved in either direction on the path by means of a pair of dice.

6 Claims, 15 Drawing Figures

BOTTLE OF BEER 1oz 50¢
IT'S YOUR BIRTHDAY AND
YOU DOWN FOUR BEERS

4oz 30MINUTES $2

FIG.2

GIN AND TONIC 1oz $1
YOU DOZE OFF IN A BOOTH
AFTER ONE DRINK

1oz 45MINUTES $1

FIG.3

SNOWSHOE 1 1/2oz $3.50
BARTENDER THOUGHT YOU
SAID A DOUBLE

3oz 15MINUTES $3.50

FIG.4

PINK LADY 1oz $4
THE DRINK IS TO STRONG
YOU LEAVE IT

0oz 0MINUTES $4

FIG.5

0.10-0.15 BLOOD ALCOHOL
TRUCK AHEAD OF YOU STOPS
YOU DRIVE FRONT OF YOUR
CAR UNDER THE TRAILER
AND BREAK YOUR NECK
REMOVE TOKEN FROM GAME
0.16-UP
TRUCK AHEAD STOPS, YOU
RUN INTO THE BACK OF THE
TRAILER ALL IN YOUR CAR
ARE KILLED
REMOVE TOKEN FROM GAME

FIG.6

0.10-0.15 BLOOD ALCOHOL
YOU BRAKE SUDDENLY AND
BREAK OFF YOUR FRONT
TEETH ON THE STEERING
WHEEL AND THEN DRIVE
OFF
0.16-UP
CAR SWERVES AND ROLLS
OVER, A COMPANION IS KILL-
ED YOU SURRENDER TO
POLICE
REMOVE TOKEN FROM GAME

FIG.7

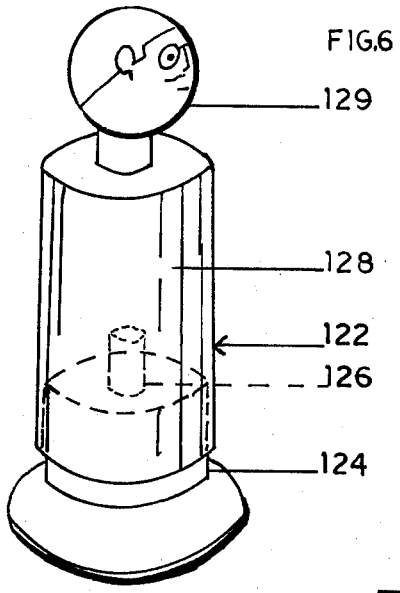

FIG.8

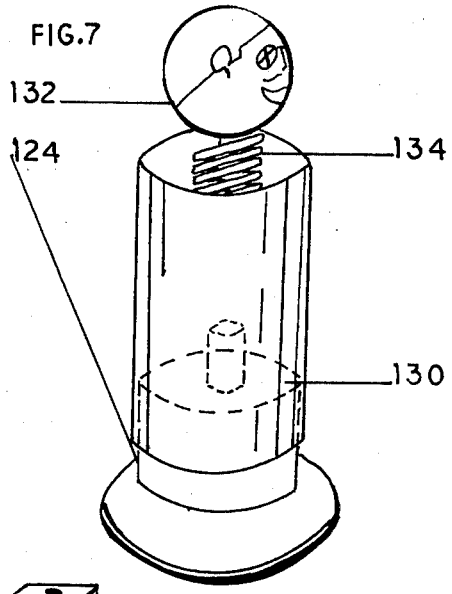

FIG.9

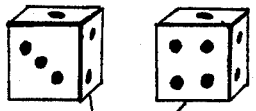

FIG.10

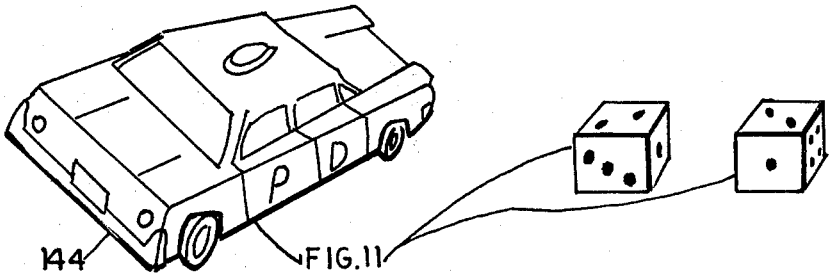
FIG.11
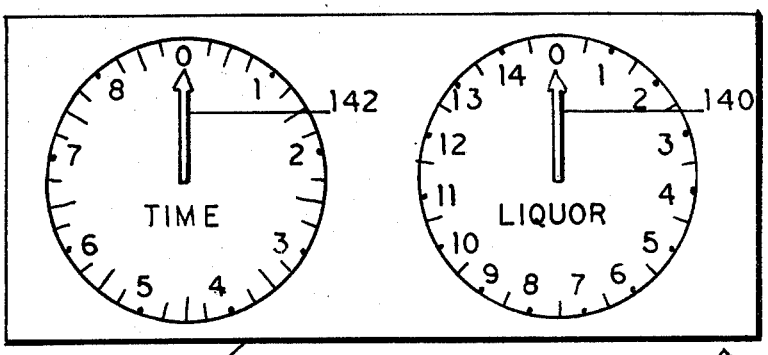
FIG.12
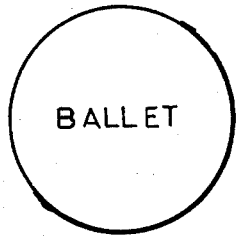
FIG.13
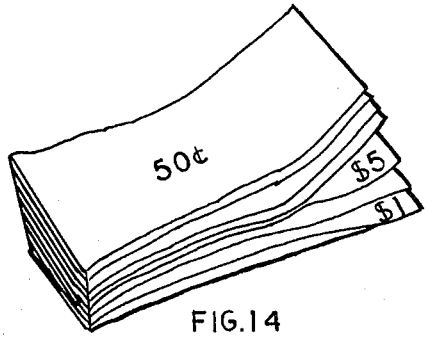
FIG.14
| TIME | 1/2 | 1 | 11/2 | 2 | 21/2 | 3 | 31/2 | 4 | 41/2 | 5 | 51/2 | 6 | 61/2 | 7 | 71/2 | 8 |
|---|---|---|---|---|---|---|---|---|---|---|---|---|---|---|---|---|
| 0 14 | 0.29 | 0.28 | 0.27 | 0.26 | 0.26 | 0.25 | 0.24 | 0.23 | 0.23 | 0.22 | 0.21 | 0.20 | 0.20 | 0.19 | 0.18 | 0.17 |
| U 13 | 0.26 | 0.26 | 0.25 | 0.24 | 0.23 | 0.23 | 0.22 | 0.21 | 0.20 | 0.20 | 0.19 | 0.18 | 0.17 | 0.17 | 0.16 | 0.15 |
| N 12 | 0.24 | 0.24 | 0.23 | 0.22 | 0.21 | 0.21 | 0.20 | 0.19 | 0.18 | 0.17 | 0.17 | 0.16 | 0.15 | 0.15 | 0.14 | 0.13 |
| C 11 | 0.22 | 0.22 | 0.21 | 0.20 | 0.19 | 0.19 | 0.18 | 0.17 | 0.16 | 0.16 | 0.15 | 0.14 | 0.13 | 0.12 | 0.12 | 0.11 |
| E 10 | 0.20 | 0.19 | 0.19 | 0.18 | 0.17 | 0.16 | 0.16 | 0.15 | 0.14 | 0.13 | 0.13 | 0.12 | 0.11 | 0.10 | 0.10 | 0.09 |
| S 9 | 0.18 | 0.17 | 0.16 | 0.15 | 0.15 | 0.14 | 0.13 | 0.12 | 0.12 | 0.11 | 0.10 | 0.09 | 0.09 | 0.08 | 0.07 | 0.06 |
| 8 | 0.16 | 0.15 | 0.15 | 0.14 | 0.13 | 0.12 | 0.12 | 0.11 | 0.10 | 0.09 | 0.09 | 0.08 | 0.07 | 0.06 | 0.06 | 0.05 |
| 7 | 0.14 | 0.13 | 0.12 | 0.12 | 0.11 | 0.10 | 0.09 | 0.09 | 0.08 | 0.07 | 0.06 | 0.06 | 0.05 | 0.04 | 0.04 | 0.03 |
| 6 | 0.12 | 0.11 | 0.10 | 0.09 | 0.08 | 0.08 | 0.07 | 0.07 | 0.06 | 0.05 | 0.04 | 0.04 | 0.03 | 0.02 | 0.01 | |
| 5 | 0.10 | 0.09 | 0.08 | 0.08 | 0.07 | 0.06 | 0.05 | 0.04 | 0.04 | 0.03 | 0.02 | 0.01 | 0.01 | | | |
| 4 | 0.08 | 0.07 | 0.06 | 0.05 | 0.05 | 0.04 | 0.03 | 0.02 | 0.02 | 0.01 | 0.01 | | | | | |
| 3 | 0.05 | 0.05 | 0.04 | 0.03 | 0.03 | 0.02 | 0.01 | | | | | | | | | |
146
FIG.15

BOARD GAME SIMULATING DRUNK DRIVING

SUMMARY

The invention relates to a game board apparatus which correlates consumption of liquor and the time span during which the liquor is consumed. The game board includes a pathway of connected playing locations upon which a player token is progressed from a combination start and finish precinct location by means of a chance generating means such as dice. Adjacent some of the playing locations are stop locations where liquor and time can be obtained.

With the roll of dice, the player moves toward a happening such as the theater and enroute can be moved into a liquor establishment wherein liquor is consumed over a stated period of time all evidenced on a card drawn by the player. The amount of liquor consumed and the time of consumption in the various liquor establishments are recorded on a display board. Information from the display board is transferred to a blood alcohol chart which indicates sobriety or drunkenness. If a player is shown to be drunk, the sober player token head is changed to a token head indicating drunkenness and a police car is put into play by use of a second pair of dice.

A player to complete the game must attend four happenings as he progresses along the playing location pathway around the board. A drunk player is eliminated from the game by occupying the same playing location as the police car or by landing on a road hazard playing location and drawing a card that can, in some cases, eliminate the drunk from the game depending upon the degree of intoxication. If a player is ready to finish the game, he must land on or pass over the combination start and finish precinct rectangle just as a sober player must. However, if the police car is in the start precinct rectangle, the drunken player must go around the board once more. The police car has no effect on the sober player token as he progresses to finish the game.

There are stop locations which award time to a player adjacent to the playing pathway which aids in retaining sobriety and also enables a drunk player to attain sobriety.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 2 is an illustration of a bar card used in the game.

FIG. 3 is a further illustration of a bar card.

FIG. 4 is an illustration of a lounge card used in the game.

FIG. 5 is a further illustration of a lounge card.

FIG. 6 is an illustration of a drunk card used in the game.

FIG. 7 is a further illustration of a drunk card.

FIG. 8 illustrates a player token with fixed head indicating sobriety.

FIG. 9 illustrates a player token with a flexible head indicating intoxication.

FIG. 10 is a pair of dice used in the progression of the player tokens around the board.

FIG. 11 illustrates a police car and a pair of dice used in moving the police car.

FIG. 12 is a top plan view of a display board with a counting dial for ounces and half ounces of liquor consumed and a counting dial in hours and quarter hours for the time elapsed during the consumption of liquor.

FIG. 13 is a counter piece for indication of the attendance of a happening.

FIG. 14 is an illustration of paper money in denominations of 0.50¢, $1, and $5 given to each player.

FIG. 15 is a blood alcohol concentration level chart by amount of liquor consumed and time elapsed.

Figure 1:
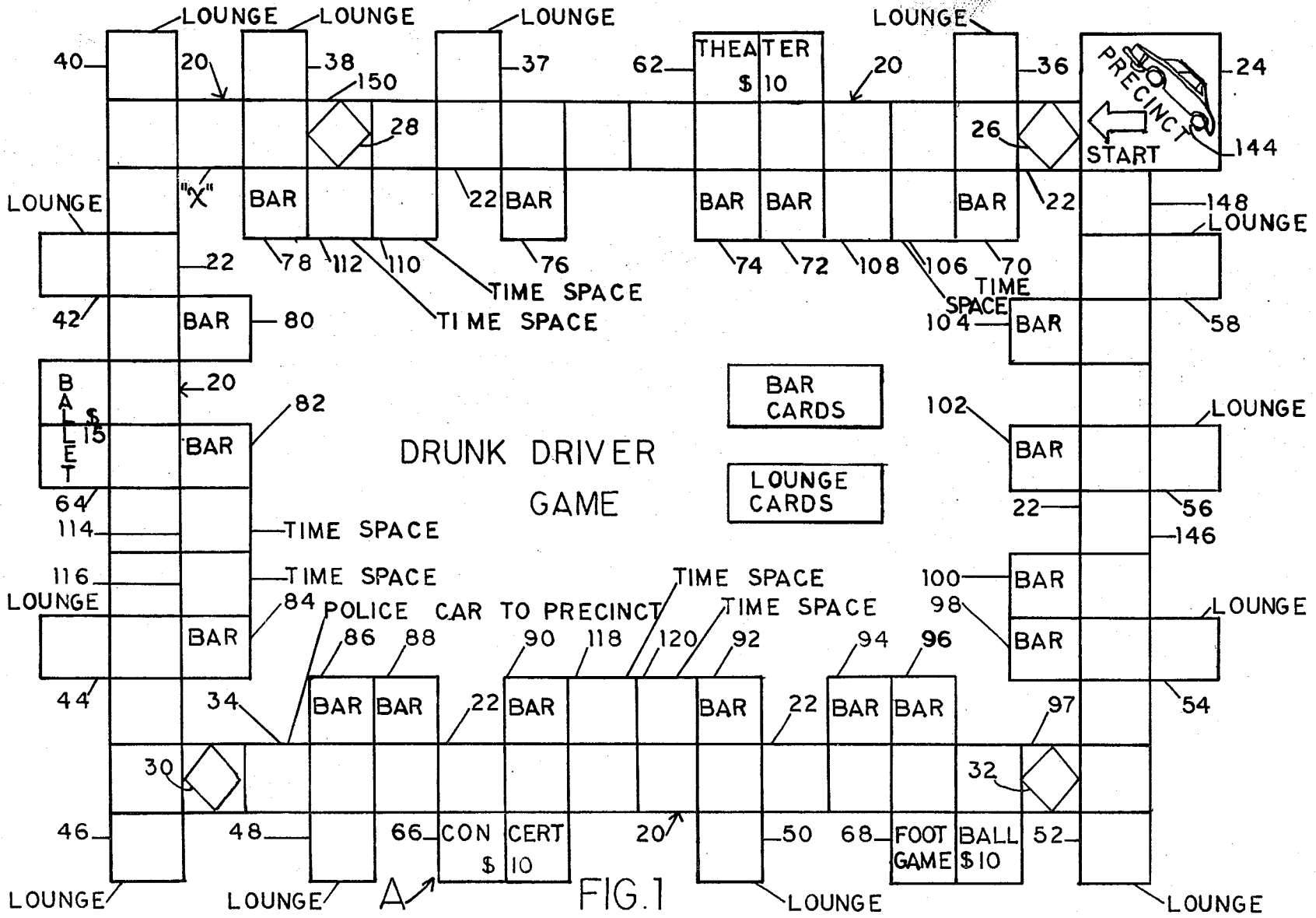
FIG. 1 is a top plan view of a game board embodying the invention.

Referring to the drawings in detail, the game board A includes a path 20 extending adjacent the perimeter of the board and is formed of a multiplicity of rectangles 22 joined together and forming playing locations for progression of tokens used in the game and hereinafter referred to. Further provided is the start and precinct rectangle 24 which also serves as a finish rectangle. Indicated in various rectangles 22 are the road hazards 26, 28, 30 and 32. Numeral 34 designates a rectangle with instructions to the police car to return to the start precinct square 24.

Outside and adjacent to the path 20 are a number of randomly spaced rectangles indicating liquor establishments such as lounges numbered 36, 37, 38, 40, 42, 44, 46, 48, 50, 52, 54, 56, and 58. Further provided are a series of four happenings each indicated by a double rectangle 62, 64, 66 and 68 outside of and adjacent the path 20. Inside and adjacent the path 20 are a series of rectangles indicating liquor establishments such as bars selling liquor which are randomly spaced and numbered 70, 72, 74, 76, 78, 80, 82, 84, 86, 88, 90, 92, 94, 96, 98, 100, 102 and 104. Additionally provided are time spaces indicated by rectangles 106, 108, 110, 112, 114, 116, 118 and 120 inside of and adjacent the path 20.

In FIG. 8 the player token 122 includes the base 124 having the reduced portion 126 which removably fits into a hole formed in the body portion 128. The body portion 128 has a fixed head 129 indicating sobriety. Further provided is a body portion 130 of FIG. 9 which may be removably mounted on the base 124, and the body 130 has the head 132 connected to the body 130 by means of the coil spring 134 which allows head movement indicating drunkenness as in FIG. 9.

In FIG. 10 is shown a pair of conventional dice for throwing, the total number of spots thereof designating the number of rectangles to proceed upon with the player token 122.

In FIG. 1 on the game board, there is illustrated a pile of bar cards and a pile of lounge cards used in the game.

With reference to FIGS. 2 and 3 further and additional bar cards contain the following legends:

Cloudy Sky, 1 oz., $1, Go to ballet, 1 oz., 0 minutes, $1;

Gin and Sour, 1 oz., $1, Owner has a crush on you and sets up a free drink, 2 oz., 15 minutes $1;

Martini, 1½ oz., $1, Bartender shortpours your martini, 1 oz., 15 minutes, $1;

Rum and Coke, 1 oz., $1, Go to football game, 1 oz., 0 minutes, $1;

Scotch and Milk, 1 oz., $1, Go to concert, 1 oz., 0 minutes, $1;

Cubra Libre, 1 oz., 0.50¢, You hit the person next to you for suggesting such a thing and depart, 1 oz., 15 minutes, 0.50¢;

Whiskey Sour, 1 oz., $1, The old man next to you falls asleep you drink his drink, 2 oz., 15 minutes, $1;

Bloody Mary, 1 oz., 0.50¢, You win the arm wrestling contest and two free drinks, 3 oz., 1 hour, 0.50¢;

Boilermaker, 1½ oz., 0.50¢, You win the fast drink contest and get a free one, 3 oz., 30 minutes, 0.50¢;

Salty Dog, 1 oz., 0.50¢, You are ejected for fighting, 0 oz., 15 minutes, $0;

Straight Whiskey (double), 2 oz., 0.50¢, After you pay for your drink the nice old lady you've been talking with runs out the door with half your dollars, 2 oz., 15 minutes, 0.50¢;

Gimlet, 1½ oz., 0.50¢, Because of your language the bartender throws you out, 0 oz., 15 minutes, $0;

Cognac and Coke, 1 oz., 0.50¢, The sailor with you objects to your off-color jokes, you are asked to leave, 1 oz., 30 minutes, 0.50¢.

With reference to FIGS. 4 and 5 further and additional lounge cards contain the following legends:

Russian Lullaby, 2 oz., $3, You argue with the Maitre d' and are ejected, 2 oz., 15 minutes, $0;

Gin Fizz, 1 oz., $4, You pass out at the bar, 1 oz., 30 minutes, $4;

6 oz. glass of wine, 1 oz., $4, Go to concert, 1 oz., 15 minutes, $4;

Gum Drop, 1½ oz., $3, For making obscene gestures at the band you are asked to leave, 1½ oz., 0 minutes, $3;

Peapicker, 1 oz., $1.50, You order a round of drinks for the 5 people at the bar, 1 oz., 30 minutes, $9;

Shirley Temple, 0 oz., $5, You order something exciting, 0 oz., 15 minutes, $5;

Rusty Nail, 1½ oz., $3, After one drink you are thrown out bodily for hollering and crying, 1½ oz., 30 minutes, $3;

Perfect Manhattan 1½ oz., $3, Attire incorrect you are not admitted, 0 oz., 0 minutes, $0;

White Russian, 1½ oz., $1.50, You fall backwards out of your chair and are asked to leave, 1½ oz., 15 minutes, $1.50;

Moscow Mule, 1 oz., $1.50, Bartender burns your drink, 2 oz., 15 minutes, $1.50;

Brandy Alexander, 1 oz., $2, You continue to dance after the music stops and are asked to leave, 1 oz., 30 minutes, $2;

Banshee, 1 oz., $4, You are caught talking to a potted palm and leave, 1 oz., 30 minutes, $4;

Hot Toddy (double), 3 oz., $5, You complain loudly there is no liquor in your drink and are asked to leave; 3 oz., 15 minutes, $5.

With reference to FIGS. 6 and 7 further and additional drunk cards contain the following legends:

0.10–0.15 blood alcohol, You stop your car on the freeway and wander around in a daze. You then get back in the car and drive off.; 0.16–up, You stop your car on the freeway, when you get out you are hit and killed by an oncoming vehicle. Remove token from game.;

0.10–0.15 blood alcohol, You sideswipe an oncoming car after blacking out at wheel but drive away; 0.16–up, You black out behind the wheel and crash head on with another car, you and other driver are killed. Remove token from game.;

0.10–0.15 blood alcohol, You sideswipe a parked car, both cars are badly damaged, but you drive off.; 0.16–up, You sideswipe a parked car, then kill a pedestrian, you are taken to jail. Remove token from game.; 0.10–0.15 blood alcohol, You race another car and narrowly miss a pedestrian, then drive off; 0.16–up, You race another car and lose control on a sharp curve, your car rolls over, you are killed. Remove token from game.;

0.10–0.15 blood alcohol, You go off the road and fracture your spine, taken to hospital, paralyzed for life. Remove token from game.; 0.16–up, You go off the road and hit a tree, DOA at hospital. Remove token from game.;

0.10–0.15 blood alcohol, You lose control of your car because of double vision and hit a police car. You commit suicide in your jail cell. Remove token from game.; 0.16–up, Because of double vision you hit a police car and kill an officer. You commit suicide in your jail cell. Remove token from game.

The display board 138 of FIG. 12 includes the liquor counting dial 140 which is used to indicate ounces of liquor consumed and the time counting dial 142 used to indicate time elapsed during consumption of liquor.

The game is played as follows:

A player selects a player token 122 with a fixed head 129 and a replacement body with a movable head 132. The player token 122 with fixed head is placed on the combined start and precinct square 24 of the playing path 20, and the player is given a quantity of paper money, for example $65.00, such as in FIG. 14. Every time a player passes the start precinct square 24, he receives $15.00. If at some time a player cannot pay a charge, he loses a turn in the form of a throw of the dice. The player is also given a display board 138 on which each of the pointers 140 and 142 as to amount of liquor consumed and the time elapsed during the consumption of liquor is set to zero, FIG. 12. The remaining bank money, the blood alcohol concentration level chart 146 and the drunk cards are placed alongside the game board. The bar cards and lounge cards are shuffled and placed face down on their designated positions on the game board A.

The police car token 144 is placed in the start and precinct rectangle 24. The player throws the player token dice of FIG. 10 and assuming a throw of nine, the player moves his player token nine rectangles in the direction of the arrow on the start and precinct square and lands opposite bar 76. The player token is moved sideways into the bar 76. The player then takes a bar card such as in FIG. 3 which indicates the player intends to order a gin and tonic containing one ounce of liquor at the cost of $1.00, also what occurred in the bar. At the bottom of the card are the totals of ounces of liquor consumed by the player, the time elapsed and money expended. The $1.00 is placed with the other bank money alongside the game board. The one ounce of liquor is recorded on the liquor counting dial 140 by placing the pointer opposite the numeral 1 and the 45 minutes is recorded on the time counting dial by placing the pointer opposite the 45 minute position.

The player then throws the dice of FIG. 10 again and assuming a total roll of five, the player token is moved five path rectangles 22 starting with the rectangle opposite the bar rectangle 76 which five moves places the player token on path rectangle 22 opposite lounge rectangle 38 and bar 78. When a player token lands opposite a bar or lounge rectangle, the player must enter the bar or lounge and then pick a bar or lounge card. If the player stops opposite both a bar and lounge rectangle, he may choose which one to enter. In entering a bar, the drink charges are usually less and generally the amount of liquor consumed is greater and the bar is less reputable as compared to a lounge for the purposes of this game.

Assuming the player chose the lounge 38, he places his player token in the lounge rectangle 38. He then draws a lounge card of FIG. 4 which indicates the player consumed a snowshoe drink which contained three ounces of liquor and he spent 15 minutes in the lounge and the cost thereof was $3.50. The $3.50 is placed with the bank money alongside the game board. The three ounces of liquor consumed are added to the liquor counting dial 140, the time dial 142 is advanced 15 minutes to the appropriate position. The player then rolls the dice and assuming he rolled a total of two, he would move the player token two blank rectangles and he would be in rectangle indicated as "X" where he waits his turn with the dice.

The player rolls the dice and assuming a total of six, the player token is moved six rectangles to a blank rectangle opposite bar rectangle 82 and one of the ballet happening rectangles 64. At this point, the player can elect to go to the bar 82 or the ballet rectangle. If the player stops opposite a happening rectangle, he will choose the happening if he has not been there on a previous trip around the board, for he must attend all four different happenings on the board before he can possibly win the game. Assuming the player moves his token into the ballet rectangle, he pays the ballet stated amount of $15.00 to the bank money, and receives a counter token, as in FIG. 13, that he has attended the ballet only at the time of first attendance.

The player then shakes the dice and assuming a roll of three, the player token is placed on a path rectangle opposite the "time space" rectangle 166. The player may elect to move sideways into rectangle 116. If the player elects to move into the "time space" rectangle 116, he will receive 30 minutes to add to his display board time counter dial which versus his consumption of liquor tends to spread the consumption of liquor over a greater time span and thus keep him as sober. Assuming the player enters time space 116, the dial 142 is advanced 30 minutes to the appropriate position.

The player then rolls the two dice, of FIG. 10, again and assuming he rolled a total of seven, he moves his player token seven rectangles to one opposite bar 86 and lounge 48. The player elects to enter the bar 86 and picks a bar card indicating he ordered one boilermaker and won an additional boilermaker which totals three ounces of liquor which he consumes, and he spends 30 minutes in the bar. The player pays the amount stated on the bar card, 0.50¢, to the bank money alongside the game board. The three ounces is added to the liquor counting dial which now gives a total of seven ounces of liquor consumed. The time element of thirty minutes in bar 86 is added to the time counting dial giving a total time of two hours.

With a reference to the blood alcohol concentration level chart of FIG. 15, it is found that the player with a liquor consumption of seven ounces over a time period of two hours has an estimated percentage alcohol concentration in his blood of 0.12 and is therefore considered intoxicated. It has been found from authoritative governmental sources that a percent of 0.10 or more of alcohol in the blood indicates intoxication. The data on the chart of FIG. 15 was adapted from information from Rutgers University Center of Alcohol Studies, New Brunswick, N.J. The resilient or wobbly head 132 is substituted for the fixed head 129 on the player token to indicate drunkenness.

With the player ascertained as drunk, the drunk player must wait his turn to roll the dice. The next player rolls both dice of FIGS. 10 and 11 under the rules of the game. The dice of FIGS. 10 and 11 are both used together for the first time when the first player becomes intoxicated. The drunk player, on his next roll, rolls the player token dice and he must also roll the police car dice of FIG. 10. The player moves his token on the rectangles of the path the total number on the dice, say 12. The token is then moved to rectangle 97 with a road hazard 32. If he was sober, the road hazard means nothing, but inasmuch as the player has been determined as drunk, he must draw a drunk card, such as in FIG. 7. Each drunk card is divided into two categories, the first category being blood alcohol concentration level of 0.10–0.15 and the second category being blood alcohol concentration level of 0.16 and up. The present player because of his 0.12 percent as above, falls into the first category of 0.10–0.15 of the card for he was 0.12 as above, and as a result, he can continue playing as drunk. If he had fallen into the second category on the card, he would have been eliminated from the game because he killed his companion and surrendered to the police.

With the police car token 144 resting in the start precinct rectangle 24, a player can elect to move the police car token in either direction off rectangle 24 the number of path rectangles equal to the total throw of the police car dice of FIG. 11. In the case at hand, the drunk player would direct the police car token in the direction of rectangle 150 which is in the opposite direction of his travel. The police car dice are used when the first instance of intoxication occurs in the game. The player elects to start the police car in motion when he believes the police car token may catch up to another player token either drunk or approaching intoxication or if the player is himself intoxicated he will generally move the police car token away from himself. When one player is held as drunk, then all players roll both player token dice and police car dice at the same time. If all players revert back to sboriety, then the police car is removed to the precinct rectangle 24 and the police car dice taken from play until the next occurrence of a player becoming drunk.

When a police car token lands on a path rectangle occupied by a player token that is drunk, then the player is removed from the game as a loser, and the police car continues in the game if there is at least one player in the drunk category. The police car token moves only on the path 20. If the police car token lands in rectangle 34, then the token is returned to start precinct square 24.

If the drunk player presently on rectangle 97 rolls the player token dice a total of eleven, he then arrives in the start and finish precinct rectangle 24 and is a winner provided he has attended all four happenings as he progresses around the board one or more times and the police car token is not in the start precinct rectangle 24, or if there was no police car token in rectangle 24 and the player, in the instant case, rolled a total dice number more than eleven, which would have taken him past start and finish rectangle 24, the player would be out of the game as a winner if he had attended all four happenings as required. If the police car token had not been moved from the start and precinct rectangle, then the drunk player falling on the start and precinct rectangle 24 would be out of the game. Had the drunk player rolled the player token dice such that his total roll placed him beyond the start precinct rectangle 24, he would then have to go around the board path 20 again.

Another player rolling the player token dice and the police car dice after moving his player token according to the player token dice, can elect to leave the police car in the start and precinct rectangle 24 and move his token according to the token dice, the police car remaining in the start and precinct rectangle prevents a drunk player from going out of the game as a winner in rectangle 24 acting as a finish in the event he rolls a number on the dice which moves him on the path beyond the combination start and finish precinct rectangle 24. If the police car token can be moved through or landed on the start and precinct rectangle 24 the police car can be, at the election of the player, left in the rectangle 24.

Assuming again the player token is on rectangle 97 and he throws a five with the player token dice, it will place him on rectangle 146. If the player threw a five with the police car dice, and assuming the police car is on rectangle 24, he moves the police car to a rectangle opposite bar 72. Another player would throw both dice and first move his player token according to the player token dice roll and he would then move the police car according to the total roll of the police car dice. Assuming the player threw an eleven with the police car dice, he would move towards bar 98 and land on rectangle 146 and knock out the drunken player. If the same player threw less than eleven and more than four total, he could leave the player car token in the start and precinct rectangle 24 to conceivably prevent the drunk player from going out by throwing more than a six roll and eliminating the drunk if he throws a six and lands in the start and precinct rectangle 24 where the drunken player resting on rectangle 146 as above rolls a five then he would be in rectangle 148. Assuming the drunk player rolls a twelve on the police car dice, the police car can be elected to be placed on rectangle 150. If the next player on his police car dice roll did not throw a twelve, the police car would not go back as far as rectangle 24 and the drunk player token could go out on his next roll of player token dice.

Having thus described the invention, what is claimed as new and desired to be secured by Letters Patent is:

1. A gameboard apparatus for a game simulating possible experiences of a player consuming liquor in relation to a time span comprising in combination:

(a) a gameboard having a series of playing locations thereon and forming a path about the board, (b) player stop locations adjacent some of said path locations, said stop locations comprising two types, each type identified by indicia distinct from the indicia on the other type;

(c) player tokens for moving on said playing locations and said stop locations;

(d) first chance means for controlling the movement of said player tokens;

(e) two decks of cards, the cards in the first deck having indicia on the reverse thereof corresponding to the indicia on said first type of stop location, the cards in the second deck having indicia on the reverse thereof corresponding to the indicia on said second type of stop location, the obverse of each of said cards in both decks having two distinct types of indicia thereon the first type of indicia indicating the amount of liquor consumed, the second type of indicia indicating the time elapsed in consuming the liquor;

(f) a blood alcohol concentration level chart divided into rows and columns in a grid-like fashion, the rows thereon identified by indicia corresponding to said first type of obverse indicia, the columns thereon identified by indicia corresponding to said second type of obverse indicia, and wherein the intersections of each of said columns with each of said rows has indicia therein yielding a blood alcohol concentration level;

(g) a third deck of cards, the reverse of each card in the third deck having indicia thereon corresponding to the indicia on said indicia-bearing playing locations, the obverse of each card in the third deck having indicia thereon corresponding to said blood alcohol concentration level indicia;

(h) a playing token simulating a police car (i) a second chance means for determining the movement of said police car token.

2. The apparatus of claim 1 in which said first chance means includes a pair of dice.

3. The apparatus of claim 2 in which said second chance means includes a pair of dice.

4. The apparatus of claim 2 in which said player tokens simulate human beings.

5. The apparatus of claim 1 in which said second chance means includes a pair of dice.

6. The apparatus of claim 1 in which said player tokens simulate human beings.

* * * * *